US008610640B2

(12) United States Patent
Nichols

(10) Patent No.: US 8,610,640 B2
(45) Date of Patent: Dec. 17, 2013

(54) ANTENNA SYSTEM SUITABLE FOR MARINE SSB RADIO

(76) Inventor: Eugene Carlton Nichols, Blaine, WA (US)

( * ) Notice: Subject to any disclaimer, the term of this patent is extended or adjusted under 35 U.S.C. 154(b) by 435 days.

(21) Appl. No.: 13/074,918

(22) Filed: Mar. 29, 2011

(65) Prior Publication Data

US 2012/0249397 A1 Oct. 4, 2012

(51) Int. Cl.
*H01Q 1/42* (2006.01)

(52) U.S. Cl.
USPC ..... 343/872; 343/791; 343/715; 455/11.1; 455/573

(58) Field of Classification Search
USPC ..... 343/872, 791, 715; 455/11.1, 573
See application file for complete search history.

(56) References Cited

U.S. PATENT DOCUMENTS

| | | | | |
|---|---|---|---|---|
| 5,345,247 | A * | 9/1994 | Aldama et al. | 343/791 |
| 6,469,590 | B1 * | 10/2002 | Lewis et al. | 333/17.3 |
| 7,200,358 | B1 * | 4/2007 | Newman et al. | 455/11.1 |
| 2006/0236910 | A1 * | 10/2006 | Boucher et al. | 114/90 |

* cited by examiner

*Primary Examiner* — Allyson Trail
(74) *Attorney, Agent, or Firm* — Oakwood Law Group, LLP; Jie Tan

(57) ABSTRACT

An antenna system suitable for marine SSB radio. The system includes a plurality of insulated conductors each having a first end and a second end; the first ends of the conductors are connected at a connection point. The insulated conductors are disposed within a tubing segment, which is sealed with a plug proximate to the connection point. A conductor connected to the connection point extends through the plug is configured for connection to a SSB radio tuner. In an embodiment, each of the conductors has a length greater than that of the tubing segment, and thus has a loop within the tubing segment. Each of the conductors advantageously has a different length, with the lengths of the conductors corresponding to quarter-wave-length antenna elements covering a frequency range of about 2 MHz to about 28 MHz.

10 Claims, 2 Drawing Sheets

ANTENNA SYSTEM SUITABLE FOR MARINE SSB RADIO

FIELD OF THE DISCLOSURE

This disclosure relates to single sideband (SSB) radio, commonly used on oceangoing vessels, and more specifically to an antenna system suitable for smaller vessels and yachts for improving signal strength and quality.

BACKGROUND OF THE DISCLOSURE

Standard marine VHF radio involves line-of-sight communication between stations; once sailors venture far from the sight of land, communication with a standard marine VHF radio is no longer feasible. In order to communicate over long distances, many mariners use high frequency (HF) single side band (SSB) radio, which operates in a frequency range of approximately 2 MHz to 28 MHz. The range of SSB is up to several thousand miles and calls between yachts are free. In most parts of the world, a SSB operator can communicate with the coast guard up to several hundred miles offshore. Using modern SSB equipment, sailors can receive global weather reports via facsimile, and send and receive email.

SSB radio offers security, entertainment and general communications while at sea. In particular, since SSB is a "party line" system where all operators on a given channel can hear each others' communications, it is ideal for coordinating rescues at sea, for offshore ocean race position roll calls, and for marine "nets" where cruisers gather on a schedule to discuss topics of interest.

The strength of transmitted radio signals, and the quality of radio reception, often depends on the performance of the antenna. An oceangoing boat typically carries a dipole antenna using the seawater surface as a reflector. However, boats have stringent space limitations; a straight quarter-wavelength antenna at 2 MHz would be approximately 37 m long and thus impractical for a typical vessel, particularly a sailing yacht. It therefore is desirable to implement an antenna system for SSB radio that is a suitable size while providing usable signal strength and reception quality.

SUMMARY OF THE DISCLOSURE

In accordance with the disclosure, an antenna system is provided which is suitable for marine SSB radio. The antenna system includes a plurality of insulated conductors each having a first end and a second end; the respective first ends of the conductors are connected at a connection point. The system also includes a tubing segment within which the insulated conductors are disposed, and a plug sealing the tubing segment at an end thereof proximate to the connection point. An additional conductor, having a first end connected to the connection point, extends through the plug and has a second end configured for connection to a SSB radio tuner. At least one of the conductors has a length greater than that of the tubing segment, and accordingly has a loop within the tubing segment. In an embodiment, each of said conductors has a length greater than that of the tubing segment, so that each of the conductors has a loop within the tubing segment. Each of the plurality of conductors advantageously has a different length, with the lengths of the conductors corresponding to quarter-wavelength antenna elements covering a frequency range of about 2 MHz to about 28 MHz.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

Figure 1:
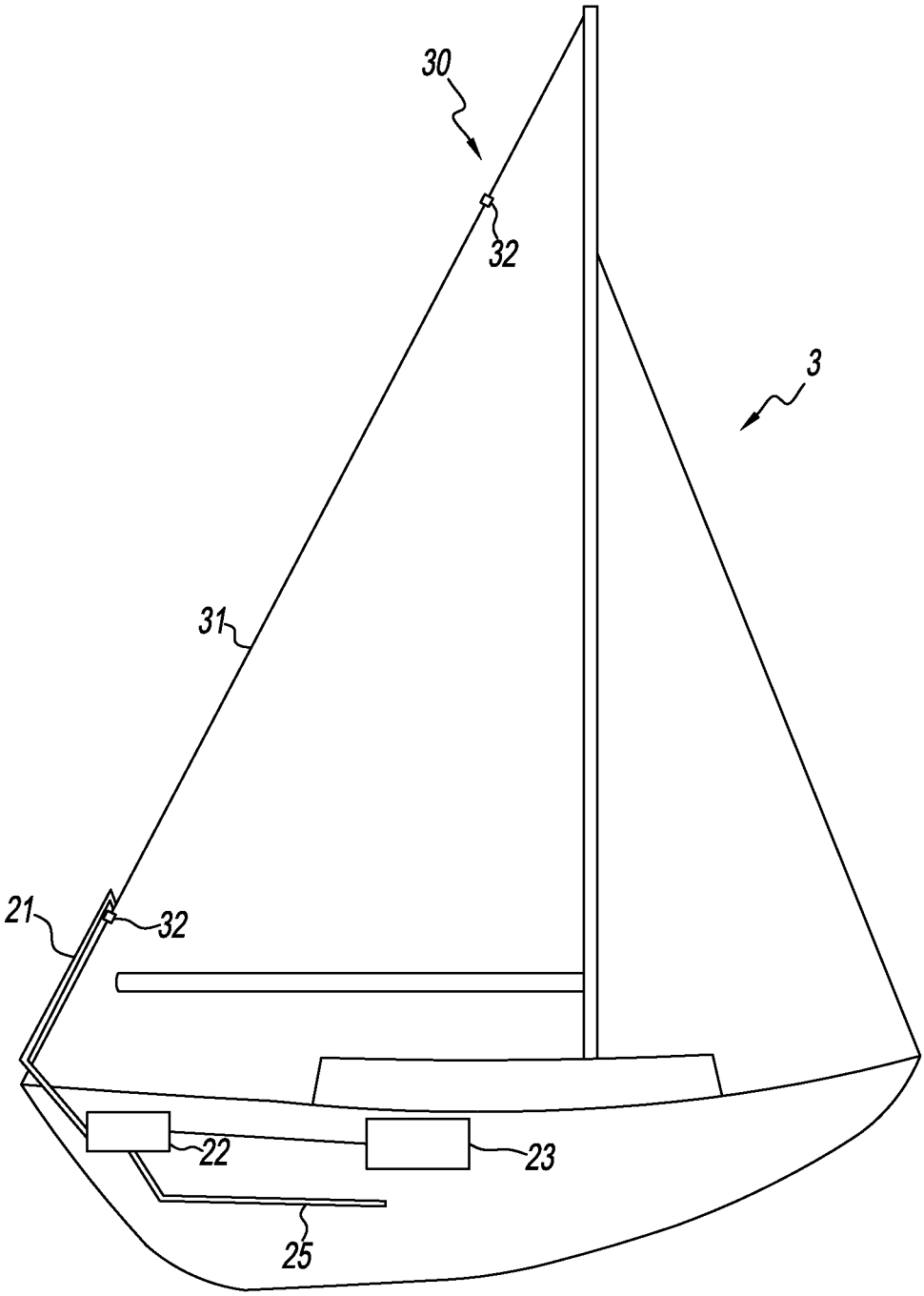
FIG. 1 illustrates a SSB radio installation on a sailing yacht, including a radio set, a tuner and an antenna system embodying the disclosure.

A SSB radio installation on a sailing yacht 3, according to an embodiment of the disclosure, is shown in FIG. 1. The longest conducting object on a yacht is typically part of the standing rigging, specifically the backstay 30 on a sloop-rigged vessel as shown in FIG. 1. When the backstay is constructed with insulators 32 as shown in FIG. 1, a backstay antenna 31 is provided between the insulators. A conductor 21 (antenna lead-in) leads from the backstay antenna to a tuner 22 (e.g. Icom AT-140) which is connected to SSB radio set 23 (e.g. Icom IC-M802). According to an embodiment of the disclosure, tuner 22 also is connected to antenna system 25.

Figure 2:
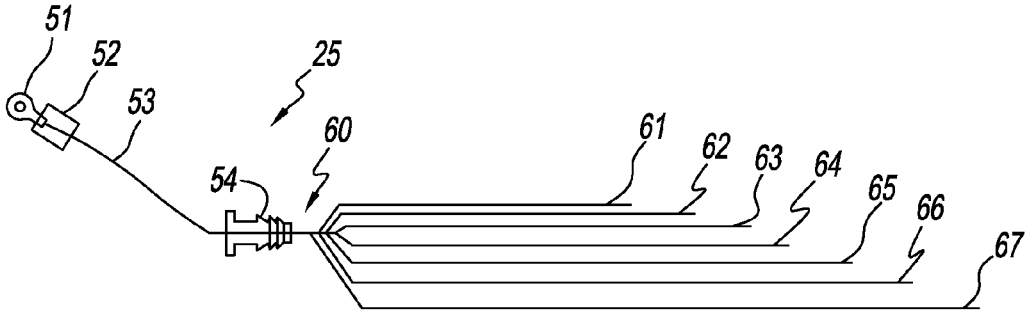
FIG. 2 illustrates the internal construction of an antenna system connected to the tuner of FIG. 1, in accordance with an embodiment of the disclosure.
Figure 3:
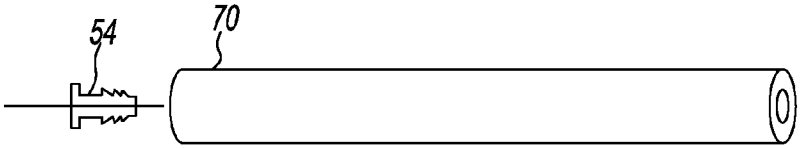
FIG. 3 illustrates a portion of the exterior of the antenna system of FIG. 3.

FIG. 2 shows details of the construction of antenna system 25. A ring terminal 51 (a 5/16 inch lug in this embodiment) provides a connection point to tuner 22. Terminal 51 connects to a wire conductor 53; this connection (typically a solder joint) is covered by a sleeve 52—in this embodiment, a short (approximately ½ inch) length of heat-shrink tubing. Conductor 53 comprises a 10 gauge stranded tinned copper wire, about 47 inches (1.19 m) long, with PVC and/or rubber insulation. Conductor 53 passes through a plug 54 which seals one end of a length of flexible tubing 70 (see FIG. 3). In the embodiment shown, plug 54 is a barbed PVC plug with a ½ inch outside diameter which mates with tubing 70 having a ½ inch inside diameter.

Inside tubing 70 are disposed a plurality of conductors, connected together and connecting to conductor 53 at connection point 60 proximate to plug 54. The connection at point 60 is preferably formed by twisting and/or soldering the conductors. In this embodiment, there are seven conductors 61-67, each of which is a 20 gauge solid copper wire with PVC insulation.

As shown schematically in FIG. 2, conductors 61-67 in this embodiment are of varying lengths, as follows:

| | | |
|---|---|---|
| 61: | 10 feet 2½ inches | (3.11 m) |
| 62: | 12 feet 4¾ inches | (3.78 m) |
| 63: | 14 feet 10¾ inches | (4.54 m) |
| 64: | 24 feet 2 inches | (7.37 m) |
| 65: | 33 feet 7¾ inches | (10.26 m) |
| 66: | 52 feet 4¾ inches | (15.97 m) |
| 67 | 53 feet 7¼ inches | (16.34 m) |

Each of conductors 61-67 longer than tubing 70; accordingly, each conductor is looped back and forth inside tubing 70. In this embodiment, tubing 70 is rubber reinforced PVC tubing with an outside diameter of 1 inch and a length of 118½ inches (3.0 m).

It will be appreciated that the lengths of conductors 61-67 correspond to quarter-wavelength antenna elements covering the frequency range of about 2 MHz to about 28 MHz—that is, the marine HF frequency range.

The disclosure is not bound by any theory of operation. It is believed that antenna system 25, when connected to tuner 22 (and with tuner 22 connected to backstay antenna 31 as described above), acts as a set of inductively loaded dipole elements in parallel with the tuner, bringing the backstay antenna element to resonance and thus effectively making the backstay antenna a loaded, off-set fed (with one element shortened, one element tuned) vertical dipole antenna over a seawater reflector. Furthermore, it is believed that the antenna system of the present disclosure is effective to use coil loaded ¼ waves so that there is a current maximum at the feed point, thereby maximizing the radiated signal, the only ground loss being the ohmic loss in the inductance of the coils. Because the coils (in this embodiment, the looped conductors 61-67) are staggered down the length of system 25 (that is, along the length of tubing 70), there is also some capacitive loading from the non-resonant elements, thereby improving bandwidth and decreasing undesired resonances. As shown in FIG. 1, antenna system 25 is advantageously installed underneath tuner 22, thereby helping to preserve the omnidirectional radiation pattern of the antenna.

An antenna system constructed according to the above-described embodiment has been tested with a maximum input power of 500 Watts and over the range 2 MHz to 28 MHz, and found to have a standing-wave ratio (SWR) of 1.2:1 or better. Such a system is suitable for SSB installations on wood or fiberglass vessels.

While the disclosure has been described in terms of a specific embodiment, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

What is claimed is:

1. An antenna system for a radio installation including a radio tuner, the antenna system comprising:

a plurality of insulated conductors each having a first end and a second end, the respective first ends of the conductors being connected at a connection point;

a tubing segment within which said insulated conductors are disposed;

a plug sealing the tubing segment at an end thereof proximate to the connection point; and an additional conductor having a first end connected to the connection point, extending through the plug, and having a second end configured for connection to the radio tuner, wherein at least one of the conductors has a length greater than that of the tubing segment, said one of the conductors accordingly having a loop within the tubing segment.

2. An antenna system according to claim 1, wherein each of said conductors has a length greater than that of the tubing segment, so that each of said conductors has a loop within the tubing segment.

3. An antenna system according to claim 2, wherein the tubing segment has a length of about 3.0 m.

4. An antenna system according to claim 3, wherein the tubing segment is of rubber reinforced PVC.

5. An antenna system according to claim 1, wherein each of said plurality of conductors has a different length.

6. An antenna system according to claim 5, wherein the lengths of said plurality of conductors correspond to quarter-wavelength antenna elements covering a frequency range of about 2 MHz to about 28 MHz.

7. An antenna system according to claim 5, wherein said plurality of conductors comprises seven conductors with lengths in the range of about 3 m to about 17 m.

8. An antenna system according to claim 1, wherein said seven conductors respectively have approximate lengths of 3.11 m, 3.78 m, 4.54 m, 7.37 m, 10.26 m, 15.97 m, and 16.34 m.

9. An antenna system according to claim 1, wherein said additional conductor has a length of approximately 1.19 m.

10. An antenna system according to claim 1, wherein said radio installation is characterized as single side band (SSB) radio.

* * * * *